US009284675B2

(12) United States Patent
Koo et al.

(10) Patent No.: US 9,284,675 B2
(45) Date of Patent: Mar. 15, 2016

(54) METHOD FOR WASHING AND WASHING MACHINE

(75) Inventors: Bon Kwon Koo, Seoul (KR); Kyo Soon Chae, Seoul (KR); Byung Keol Choi, Seoul (KR); Deok Kyu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 536 days.

(21) Appl. No.: 12/879,716

(22) Filed: Sep. 10, 2010

(65) Prior Publication Data

US 2011/0061172 A1 Mar. 17, 2011

(30) Foreign Application Priority Data

Sep. 15, 2009 (KR) ..... 10-2009-0087142
Sep. 21, 2009 (KR) ..... 10-2009-0089156

(51) Int. Cl.
*D06F 35/00* (2006.01)
*D06F 37/20* (2006.01)

(52) U.S. Cl.
CPC ..... *D06F 35/007* (2013.01); *D06F 37/203* (2013.01)

(58) Field of Classification Search
CPC ..... D06F 35/00
See application file for complete search history.

(56) References Cited

U.S. PATENT DOCUMENTS

| | | | | |
|---|---|---|---|---|
| 6,578,225 | B2 * | 6/2003 | Jonsson | 8/159 |
| 2004/0194226 | A1 * | 10/2004 | Kim et al. | 8/159 |
| 2005/0016227 | A1 * | 1/2005 | Lee | 68/12.04 |
| 2006/0185403 | A1 * | 8/2006 | Ikemizu et al. | 68/12.18 |
| 2007/0157677 | A1 * | 7/2007 | Tatsumi et al. | 68/142 |
| 2008/0289118 | A1 | 11/2008 | Park et al. | |
| 2009/0139036 | A1 * | 6/2009 | Park | 8/149.3 |
| 2009/0151085 | A1 | 6/2009 | Altinier et al. | |
| 2009/0183319 | A1 | 7/2009 | Chai et al. | |

FOREIGN PATENT DOCUMENTS

| | | | |
|---|---|---|---|
| CN | 1906348 | A | 1/2007 |
| CN | 101139794 | A | 3/2008 |
| CN | 101311404 | A | 11/2008 |

* cited by examiner

*Primary Examiner* — Jason Ko
(74) *Attorney, Agent, or Firm* — Dentons US LLP

(57) ABSTRACT

A method for washing laundry and a washing machine, in which balancing of the laundry load is effectively carried out. The method for washing includes supplying wash water mixed with a detergent, spinning or rinsing the laundry by rotating the washing machine drum in which the laundry is located, thereby causing the laundry to be repeatedly lifted within and then fall towards the bottom of the drum. The method further involves balancing the laundry by repeatedly accelerating and decelerating the drum. The wash water is then drained.

12 Claims, 8 Drawing Sheets

METHOD FOR WASHING AND WASHING MACHINE

The present application claims priority to Korean Application No. 10-2009-0087142, filed in Korea on Sep. 15, 2009, and to Korean Application No. 10-2009-0089156, filed in Korea on Sep. 21, 2009, the contents of both are hereby incorporated by reference in their entirety.

BACKGROUND OF THE INVENTION

1. Field of the Invention

The present invention relates to a method for washing and a washing machine, and more particularly to a method for washing and a washing machine, in which balancing the items being washed is effectively performed.

2. Discussion of the Related Art

In general, washing machines are apparatuses, which wash clothes bedclothes and the like (hereinafter, referred to as laundry'), through processes such as washing, rinsing, and spinning, so as to remove contaminants from the laundry using water, detergent, and mechanical action. Washing machines are generally divided into agitator-type washing machines, pulsator-type washing machines, and drum-type washing machines.

The agitator-type washing machines wash laundry by rotating a washing rod rising over the center of a tub right and left. The pulsator-type washing machines wash laundry using frictional force between the water current and the laundry by rotating a circular plate-shaped rotary blade formed on the bottom of a tub right and left. The drum-type washing machines wash laundry by rotating a drum under the condition that water, a detergent, and the laundry are put into the drum.

In a drum-type washing machine, a tub containing water is installed within a cabinet forming the external appearance of the drum-type washing machine. A drum containing laundry is disposed within the tub. A motor to rotate the drum is mounted on the rear surface of the tub, and a drive shaft passing through the tub and connected to the rear surface of the drum is installed on the motor. Lifters are mounted in the drum so as to lift up the laundry during rotation of the drum.

In the above drum-type washing machine, the laundry often converges to one side of the drum due to tangling of the laundry. This, in turn, can lead to an unbalancing condition, i.e., where a heavy weight is induced on one side of the drum, relative to other locations within the drum. The unbalancing of the laundry typically causes a lot of noise and vibration during spinning, i.e., when the drum is rotated at high speed. Therefore, balancing to uniformly disperse the laundry is required.

SUMMARY OF THE INVENTION

An object of the present invention is to provide a method for washing laundry and a washing machine, in which balancing of the laundry to eliminate unbalancing of the laundry is effectively carried out.

Another object of the present invention is to provide a method for washing laundry and a washing machine, in which balancing of the laundry is carried out during a wash cycle or a rinse cycle.

Still another object of the present invention is to provide a method for washing laundry and a washing machine, wherein main-spinning is directly carried out if an unbalanced condition of laundry as measured, under the condition that wash water is supplied to the inside of a drum, is within an allowable value.

The objects of the present invention are not limited to the above-mentioned objects. As such, other objects will become evident to those skilled in the art from the following description.

To achieve the above objects, there is provided a method for washing according to an exemplary embodiment of the present invention, including supplying wash water mixed with a detergent to the inside of a tub, performing washing or rinsing by repeatedly falling laundry within a drum provided in the tub containing the wash water by rotating the drum, balancing the laundry by repeating acceleration and deceleration of the drum under the condition that the wash water is contained in the tub, and draining the wash water contained in the tub to the outside.

To achieve the above objects, there is provided a method for washing according to an exemplary embodiment of the present invention, in a wash cycle or a rinse cycle, including supplying wash water mixed with a detergent to the inside of a tub, repeatedly falling laundry within a drum provided in the tub containing the wash water by rotating the drum, and balancing the laundry by repeating acceleration and deceleration of the drum under the condition that the wash water is contained in the tub.

To achieve the above objects, there is provided a washing machine according to an exemplary embodiment of the present invention, including a tub to contain wash water, a drum provided within the tub to contain laundry, a pump to drain the wash water contained in the tub to the outside, and a control unit to balance the laundry by repeating acceleration and deceleration of the drum under the condition that the wash water is contained in the tub, and then to operate the pump.

Details of these and of other exemplary embodiments will be incorporated by the following description and drawings.

DETAILED DESCRIPTION OF THE PREFERRED EMBODIMENTS

Figure 1:
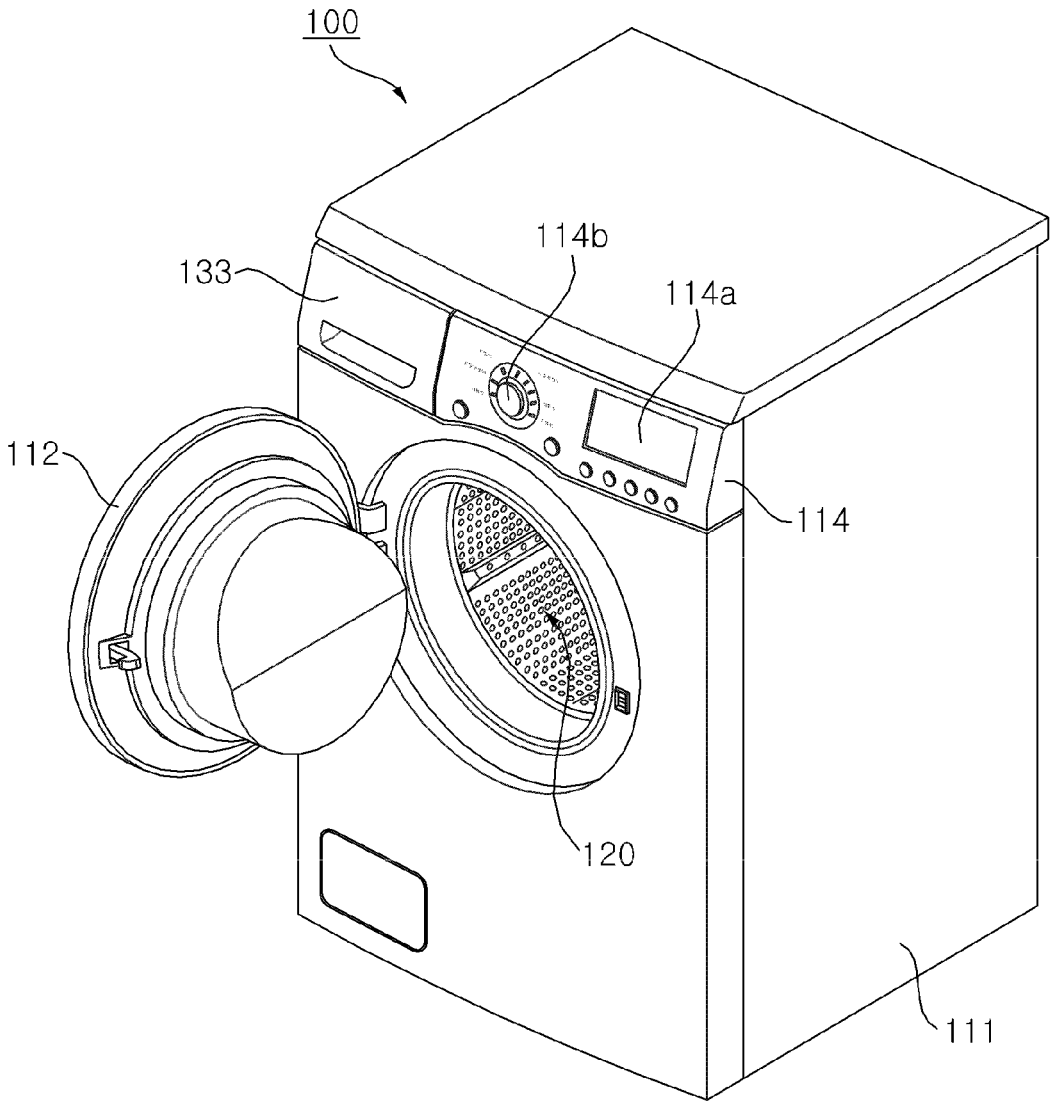
FIG. 1 is a perspective view of a washing machine in accordance with one embodiment of the present invention.

The advantages and features of the present invention, and the way of attaining them, will become apparent with reference to the exemplary embodiments described below in conjunction with the accompanying drawings. However, the present invention is not limited to the exemplary embodiments disclosed below and can be embodied in a variety of different forms; rather, these embodiments are provided so that this disclosure will be thorough and complete, and will fully convey the scope of the present invention to those skilled in the art. The scope of the present invention will be defined by the appended claims. Like reference numerals refer to like elements throughout the specification and the accompanying figures.

The exemplary embodiments of a method for washing and a washing laundry machine according to the present invention will be hereinafter described in detail with reference to the accompanying drawings.

Figure 2:
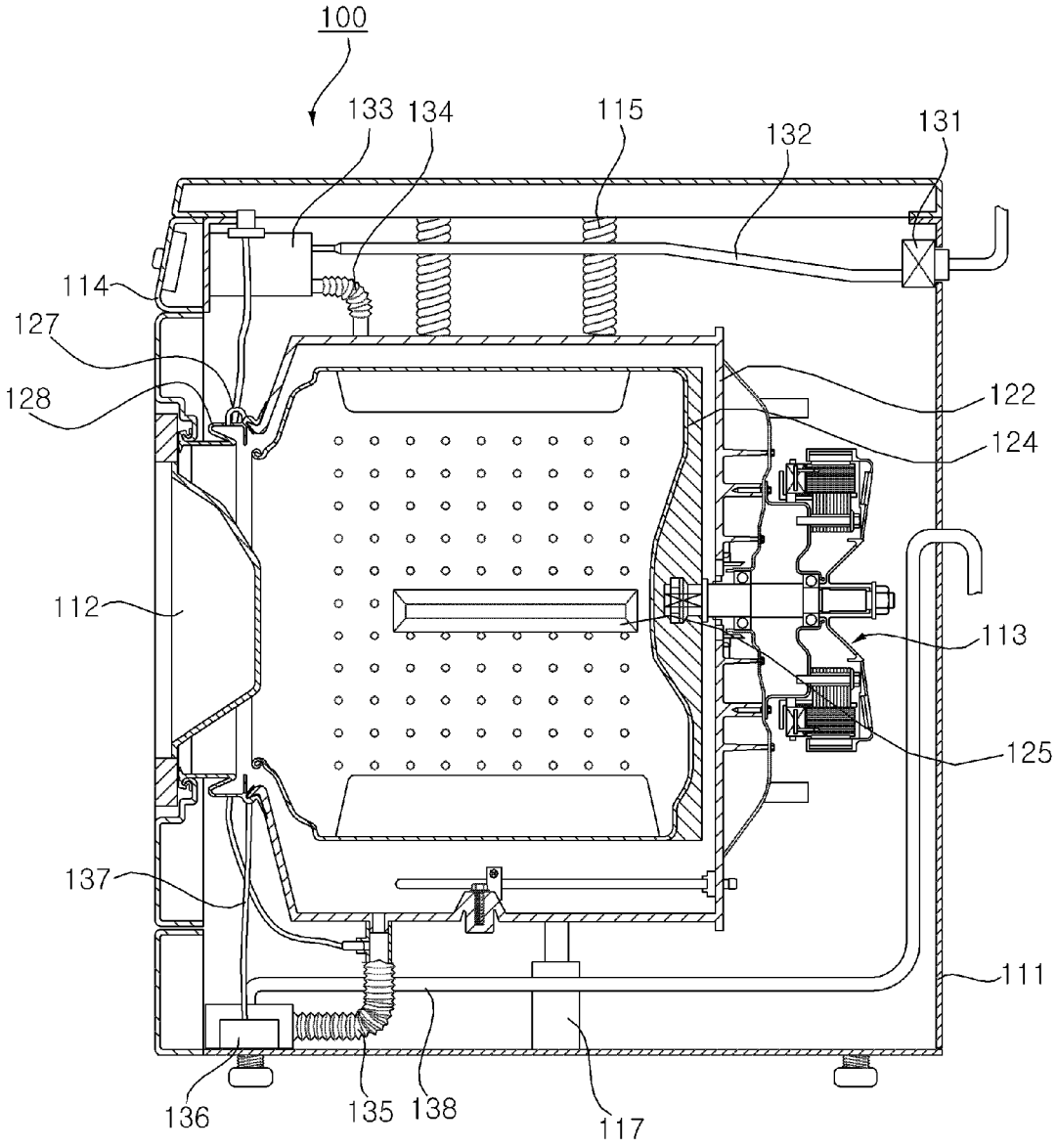
FIG. 2 is a longitudinal-sectional view of the washing machine of FIG. 1.

FIG. 1 is a perspective view of a washing machine in accordance with one embodiment of the present invention. FIG. 2 is a longitudinal-sectional view of the washing machine of FIG. 1. As shown, a washing machine 100, in accordance with this embodiment, includes a cabinet 111 forming the external appearance of the washing machine 100, a door 112 to open and close one side of the cabinet 111 so that laundry may be placed inside and removed from within the cabinet 111, a tub 122 disposed in the cabinet 111 and supported by the cabinet 111, a drum 124 disposed in the tub 122 and rotated under the condition that laundry is inside the drum 124, a driving unit 113 for applying torque to the drum 124 in order to rotate the drum 124, a detergent box 133 to contain detergents, and a control panel 114 to receive user input and to display the state of the washing machine 100.

The cabinet 111 is provided with an opening 120, through which the laundry is placed in and taken out of the cabinet 111. The door 112 is rotatably connected to the cabinet 111 so as to open and close the opening 120.

The control panel 114 is provided on the cabinet 111. Further, the detergent box 133 is provided on the cabinet 111 such that the detergent box 133 may be drawn out of the cabinet 111.

The tub 122 is disposed within the cabinet 111 and held in place by springs 115 and a damper 117 such that impact applied to the tub 122 may be absorbed by the springs 115 and the damper 117. The tub 122 contains wash water during the washing process. The drum 124 is disposed within the tub 122.

The drum 124 is rotated under the condition that laundry is contained in the drum 124. The drum 124 is provided with a plurality of through holes so as to pass wash water. Lifters 125 to lift up the laundry to a designated height during the rotation of the drum 124 may be formed on the inner wall of the drum 124. The drum 124 is rotated using rotary force transmitted from the driving unit 113.

A gasket 128 seals a gap between the tub 122 and the cabinet 111. The gasket 128 is disposed between an inlet of the tub 122 and the opening 120. The gasket 128 damps the impact transmitted to the door 112 during the rotation of the drum 124 and also prevents the wash water in the tub 122 from leaking to the outside. A circulation nozzle 127, through which the wash water is supplied to the inside of the drum 124, may be provided on the gasket 128.

The driving unit 113 rotates the drum 124. The driving unit 113 includes a motor, a switching element to control the motor, a clutch, and other known components.

The detergent box 133 contains detergents, such as a wash detergent, a fabric rinse, and a bleaching agent. The detergent box 133 is preferably provided on the front surface of the cabinet 111 such that the detergent box 133 may be drawn out of the cabinet 111. The detergent in the detergent box 133 is mixed with wash water when the wash water is supplied, and then the mixture of the detergent and the wash water is supplied to the inside of the tub 122.

Preferably, a water supply valve 131 to adjust inflow of wash water from an external water source, a water supply channel 132, through which the wash water supplied to the water supply valve 131 flows toward the detergent box 133, and a water supply pipe 134, through which the wash water mixed with the detergent in the detergent box 133 flows to the inside of the tub 122, are also provided in the cabinet 111.

Further, a first drain pipe 135, through which the wash water in the tub 122 is drained, a pump 136 to drain the wash water in the tub 122, a circulation channel 137 to circulate the wash water, a circulation nozzle 127 to feed the wash water to the inside of the drum 124, and a second drain pipe 138, through which the wash water is drained to the outside, are preferably provided in the cabinet 111. According to the exemplary embodiments of the present invention, the pump 136 may include a circulation pump connected to the circulation channel 137 and a drain pump connected to the drain channel 138.

The control panel 114 includes an input unit **114*b* to receive user input and the selection of one of the washing courses or the selection of various operation instructions, such as operation time and reservation time according to respective cycles. The control panel 114 also includes a display unit 114*a* to display an operating state of the washing machine 100**.

The washing courses include a standard course, a lingerie/wool course, a hot water course, a speedy wash course, a functional clothes course, a gentle course, and the like, according to the type of laundry being washed. Operation of the washing machine 100 is generally divided into a wash cycle, a rinse cycle, and a spin cycle, and in each of the cycles, water supplying, washing, rinsing, draining, spinning, or drying is carried out. Balancing may be carried out during the wash cycle and/or the rinse cycle according to the set washing course. That is, if the laundry is the kind that is easily tangled, which can lead to an unbalanced load, detangling and unbalancing is carried out during the wash cycle or the rinse cycle, whereby the articles of clothing being washed are floated in the water.

Figure 3:
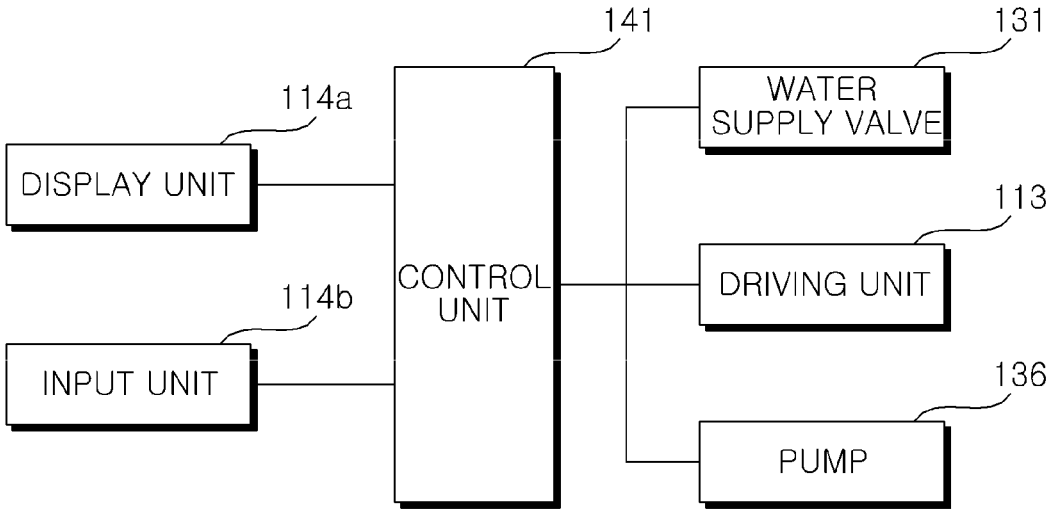
FIG. 3 is a block diagram of a washing machine in accordance with the exemplary embodiments of the present invention.

FIG. 3 is a block diagram of the washing machine in accordance with the embodiment illustrated in FIG. 1. As shown, the washing machine includes a control unit 141 which controls the overall operation of the washing machine according to operation instructions received by the input unit **114*b*. The control unit 141 is preferably provided in the control panel 114. The control unit 141 may include a micro computer to control the operation of the washing machine and other electronic parts. The control unit 141 determines which cycles are to be carried out, the time associated with each operation (i.e., water supplying, washing, rinsing, draining, spinning, drying) and the number of operation repetitions, according to the washing course selected by the user. The control unit 141 also controls the water supply valve 131, the driving unit 113, and the pump 136** according to the selected course or other operation instructions.

Figure 4:
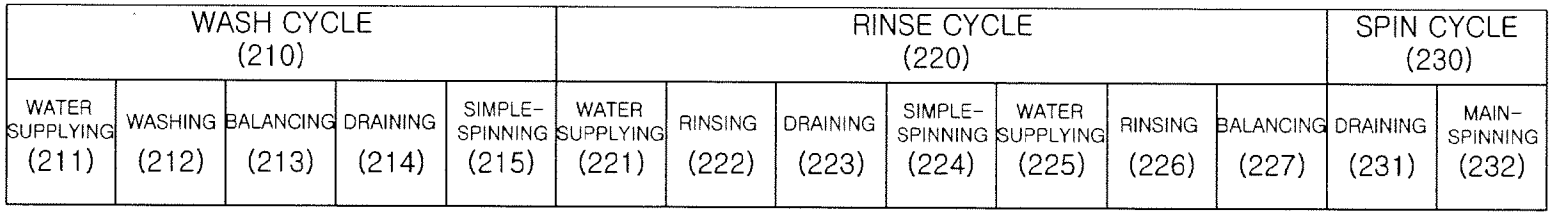
FIGS. 4 and 5 illustrate a method for washing laundry in accordance with one embodiment of the present invention.
Figure 5:
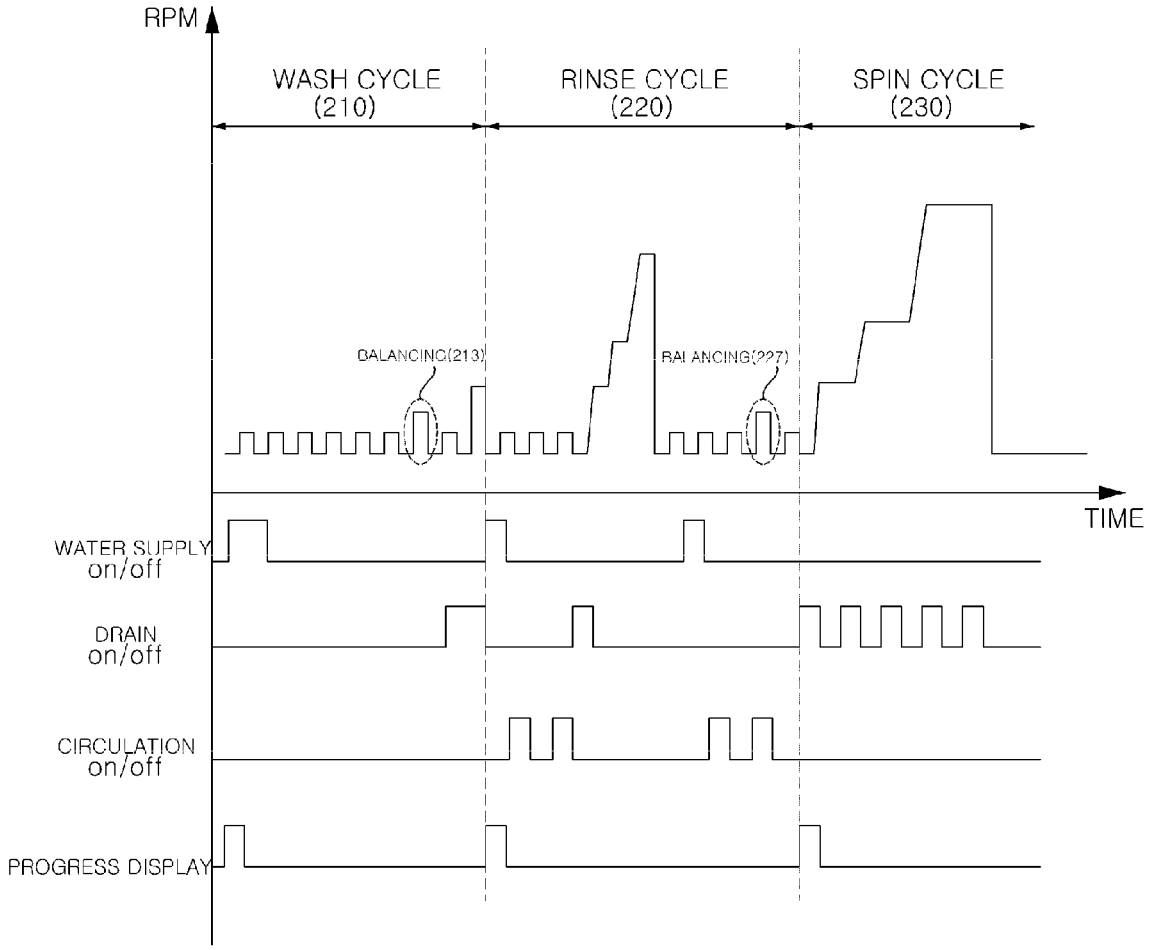
Figure 6:
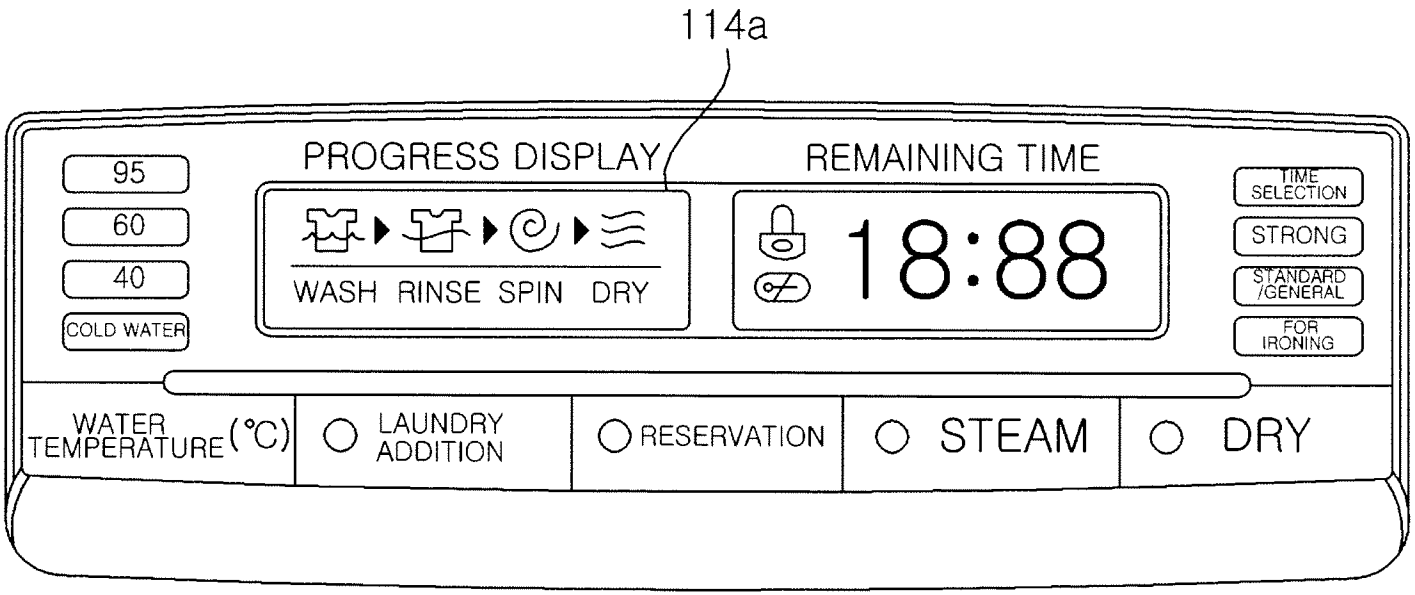
FIG. 6 illustrates a display unit of the washing machine in accordance with exemplary embodiments of the present invention.

FIGS. 4 and 5 illustrate a method for washing laundry in accordance with one embodiment of the present invention. FIG. 6 illustrates an exemplary display until **114*a*. A wash cycle 210 is a cycle in which contaminants are removed from the laundry by wetting the laundry with wash water mixed with the wash detergent and then rotating the drum 124. In accordance with this embodiment, and as illustrated in FIG. 4, the wash cycle 210 is carried out by sequentially performing water supplying 211, washing 212, balancing 213, draining 214, and simple-spinning 215**.

When the wash cycle 210 starts, the control unit 141 displays a wash icon in a progress display portion of the display unit 114*a*, as shown in FIG. 6. Accordingly, the wash icon indicates that the wash cycle 210 has been started.

The water supplying process 211 involves supplying wash water from the external water source to the inside of the tub 122. During the water supplying process 211, the control unit 141 opens the water supply valve 131 and wash water flows from the external water source via the water supply channel 132 to the detergent box 133. The wash water is mixed with the wash detergent in the detergent box 133, and then is fed to the inside of the tub 122 via the water supply pipe 134. In the detergent box 133, the wash water may also be mixed with a bleaching agent.

During the water supplying process 211, the control unit 141 operates the drive unit 113 which rotates the drum 124 such that the wash water mixed with the wash detergent uniformly wets the laundry. The water supplying process 211 is carried out until the wash water reaches a target water level, where the target water level is determined by the control unit 141 according to the amount of the laundry (hereinafter, referred to as "the laundry load"), which is measured prior to the water supplying process 211, or according to the selected course.

Preferably, the level of the wash water is measured by a water level sensing device (not shown). The laundry load may be measured using various methods. In this embodiment, the laundry load is measured by a method in which the driving unit 113 rotates the drum 124 at a designated speed for a designated time, and then the control unit 141 measures the deceleration time of the drum 124. The longer the deceleration time of the drum 124 is, the higher the level of the laundry load is.

When the wash water reaches the target water level in the tub 122, the control unit 141 closes the water supply valve 131. This finishes the water supplying process 211.

The washing process 212 involves rotating the drum 124, which contains the wet laundry and the wash water mixed with the wash detergent. During the washing process 212, when the control unit 141 drives the driving unit 113, the driving unit 113 rotates the drum 124, the laundry in the drum 124 is lifted up by the lifters 125, after which, the laundry falls back towards the lower portion of the drum 124, and contaminants are removed from the laundry by friction between the lifting and the falling of the laundry.

During the washing process 212, the control unit 141 may control the driving unit 113 such that the drum 124 may be rotated at various speeds or in various directions. In this embodiment, the drum 124 is rotated at a speed of approximately 40 rpm in a regular direction. This causes the laundry in the drum 124 to fall repeatedly. In order to prevent the driving unit 113 from overheating during the washing process 212, the control unit 141 may stop the operation of the driving unit 131 at intervals of several seconds to several minutes.

Steam may be sprayed inside the drum 124 during the washing process 212 depending on the washing course or the user selection. During the washing process 212, the control unit 141 operates the pump 136 such that the wash water is circulated along the circulation channel 137, and is supplied to the inside of the drum 124 through the circulation nozzle 127.

The balancing process 213 disperses the laundry by repeating the acceleration and deceleration of the drum 124. On occasion, the laundry converges to one side of the drum 124 due to tangling of the laundry during the washing process 212 or the rinsing process 222. This causes unbalancing of the laundry, i.e., a disproportionate heavy weight to one side of the drum is induced. The unbalancing of the laundry causes noise and vibration during the main-spinning process 232. Therefore, the balancing process 213 to uniformly disperse the laundry is required prior to the spin cycle 230, as illustrated in FIG. 4. A detailed description of the balancing process 213 will be described later with reference to FIG. 7.

The draining process 214 involves draining the wash water in the tub 122 to the outside of the cabinet 111. During the draining process 214, the control unit 141 operates the pump 136 so as to drain the wash water in the tub 122 to the outside of the cabinet 111 along the drain channel 138.

The simple-spinning process 125 involves rotating the drum 124 at a high speed so as to remove the wash water from the wet laundry. During the simple-spinning process 215, when the control unit 141 drives the driving unit 113 to rotate the drum 124 at a high speed, the drum 124 is rotated under the condition that the laundry is attached to the inner wall of the drum 124, and thus the laundry is dehydrated by centrifugal force. During the simple-spinning process 215, because it is unnecessary to spin the drum 124 enough to dry the laundry, it is preferable that the drum 124 be rotated at a speed of 108 rpm enough to attach the laundry to the inner wall of the drum 124.

Preferably, during the simple-spinning process 215, the control unit 141 intermittently operates the pump 136 so as to drain the wash water in the tub 122 to the outside along the drain channel 138.

A rinse cycle 220 is a cycle, in which the laundry is wet in wash water mixed with the fabric rinse and then the remainder of the wash water is removed from the laundry by rotating the drum 124. In accordance with this embodiment of the present invention, the rinse cycle 220 is carried out by sequentially performing water supplying 221, rinsing 222, draining 223, simple-spinning 224, water supplying 225, rinsing 226, and balancing 227, as illustrated in FIG. 4. In this embodiment, the rinsing processes is repeated 222 and 226. However, rinsing may not be repeated or may be repeated several times according to other exemplary embodiments.

FIG. 6 illustrates a display unit 114*a*. When the rinse cycle 220 is started, the control unit 141 displays a rinse icon in the progress display of the display unit 114*a*, as shown in FIG. 6, and thus indicates that the rinse cycle 220 has been started.

The water supplying process 221 involves supplying wash water from the external water source to the inside of the tub 122 in the same manner as the water supplying process 211 of the above-described wash cycle 210. During the water supplying process 221, when the control unit 141 opens the water supply valve 131, the wash water flows from the external water source via the water supply channel 132 and the water supply pipe 134 to the tub 122. It is preferable that the fabric rinse not be mixed with the wash water during the water supplying process 221; it should be mixed with the wash water only during the final water supplying process 225 of the rinse cycle 220, which will be described later. During the water supplying process 221, the control unit 141 drives the drive unit 113 to rotate the drum 124 such that the wash water uniformly wets the laundry.

The rinsing process 222 involves rotating the drum 124, in which the laundry wet with the wash water is contained. During the rinsing process 222, when the driving unit 113 rotates the drum 124, the laundry in the drum 124 is lifted up by the lifters 125. It then falls towards the bottom of the drum 124, and the remainder of the wash detergent and contaminants are removed from the laundry by friction between the laundry lifting and falling.

During the rinsing process 222, the control unit 141 may control the driving unit 113 such that the drum 124 may be rotated at various speeds or in various directions. In this embodiment, the drum 124 is rotated at a speed of approximately 40 rpm in a regular direction, which causes the laundry in the drum 124 to fall repeatedly. During the rinsing process 222, it is preferable that the control unit 141 operate the pump 136 such that the wash water is circulated along the circulation channel 137, and re-supplied to the inside of the drum 124 through the circulation nozzle 127.

The draining process 223 involves draining the wash water in the tub 122 to the outside of the cabinet 111 in the same manner as the draining process 214 in the above-described wash cycle 210.

The simple-spinning process 224 again involves rotating the drum 124 at a high speed so as to remove the wash water from the wet laundry in the same manner as the simple-spinning process 215 in the above-described wash cycle 210. During the simple-spinning process 224, the drum 124 is rotated at a higher speed of approximately 800 rpm compared to simple-spinning process 215 of the wash cycle 210.

The water supplying process 225 involves supplying wash water from the external water source to the inside of the tub 122 in the same manner as the above-described water supplying process 221 so as to repeat the rinsing process 226. It is preferable that the wash water be mixed with fabric rinse in the detergent box 133 and then supplied to the inside of the tub 122 during the water supplying process 225. During the water supplying process 225, the control unit 141 drives the drive unit 113 to rotate the drum 124 such that the wash water mixed with the fabric rinse uniformly wets the laundry.

The rinsing process 226 involves rotating the drum 124, which contains the laundry wet with the wash water, in the same manner as the above-described rinsing process 222. However, during the rinsing process 226, the wash water mixed with the fabric rinse is supplied to the laundry, thus softening the laundry.

The balancing 227 is a process of dispersing the laundry by repeating the acceleration and deceleration of the drum 124 in the same manner as the balancing 213 of the above-described wash cycle 210.

The detailed description of the balancing 227 will be described later with reference to FIG. 7.

A spin cycle 230 is a cycle in which the laundry is dehydrated by rotating the drum 124 at a high speed. In accordance with this embodiment, the spin cycle 230 includes a draining process 231 and a main-spinning process 232.

When the spin cycle 230 is started, the control unit 141 displays a spin icon in the progress display of the display unit 114*a*, as shown in FIG. 6. This indicates that the spin cycle 230 has started.

The draining process 231 involves draining the wash water in the tub 122 to the outside of the cabinet 111 in the same manner as the draining process 214 in the above-described wash cycle 210 or the draining process 223 in the above-described rinse cycle 220. According to exemplary embodiments of the present invention, the draining process 231 may be omitted and the main-spinning process 232 may be carried out directly after the balancing process 227.

The main-spinning process 232 involves rotating the drum 124 at a high speed to remove the wash water from the wet laundry. During the main-spinning process 232, when the control unit 141 rotates the drum 124 at a high speed, the drum 124 rotates under the condition that the laundry adheres to the inner wall of the drum 124, and the laundry is dehydrated by centrifugal force. During the main-spinning process 232, the drum 124 is rotated at a speed of more than 1,000 rpm, which is higher than that in the simple-spinning process 215 of the wash cycle 210 or the simple-spinning process 224 of the rinse cycle 220. Preferably, during the main-spinning process 232, the control unit 141 intermittently operates the pump 136 to drain the wash water in the tub 122 to the outside along the drain channel 138.

During the main-spinning process 232, the laundry may be dispersed by repeatedly accelerating and decelerating the drum 124 prior to the high-speed rotation of the drum 124. However, if the laundry is sufficiently dispersed by the balancing process 213 of the wash cycle 210 and the balancing process 227 of the rinse cycle 220, it may be omitted.

After the main-spinning process 232, drying, in which hot air is supplied to the inside of the drum 124 to dry the laundry, may be performed.

Figure 7:
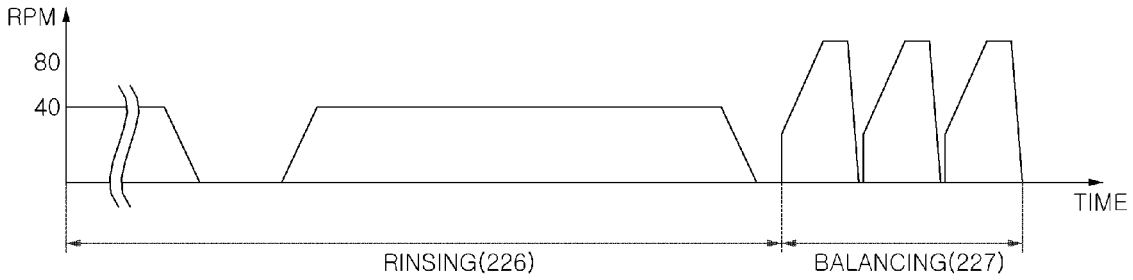
FIG. 7 illustrates a method for washing laundry that includes balancing in accordance with exemplary embodiments of the present invention.

FIG. 7 illustrates the balancing process in accordance with the exemplary embodiments of the present invention. The balancing process 213 is carried out by repeatedly accelerating and decelerating the drum 124 prior to the draining process 231 under the condition that wash water is contained in the tub 122 after the washing process 212. During the balancing process 213, the wash icon in the progress display of the display unit 114*a* is illuminated. This indicates that the wash cycle 210 is underway.

The balancing process 213 is carried out by accelerating the drum 124 at a speed of 70~80 rpm. At this speed, the laundry begins to adhere to the inner wall of the drum 124. Then the balancing process 213 involves decelerating the drum 124. Preferably, a period, in which the drum 124 is accelerated and then decelerated, is approximately 5 to 6 seconds. The driving unit 113 decelerates the drum 124 through dynamic braking, in which a motor is stopped by causing electromotive force generated from a closed circuit of the motor to be consumed by a resistance.

During the balancing process 213, the control unit 141 measures the laundry load based on the deceleration time of the drum 124, and it measures the unbalanced degree of the laundry based on the variation in the rotational speed of the drum 124 after the drum 124 is accelerated.

The control unit 141 calculates the laundry load by measuring the deceleration time of the drum 124, as described above, the longer the deceleration time, the higher the level of the laundry load. According to exemplary embodiments, the control unit 141 may alternatively calculate the laundry load by measuring the acceleration time of the drum 124.

The control unit 124 calculates the unbalanced degree of the laundry by measuring the variation in the speed of the drum 124 after the drum 124 is accelerated. The speed of the drum 124 is measured using a hall sensor, or is calculated by measuring current flowing in the motor of the driving unit 113.

The control unit 141 judges whether or not the unbalanced degree of the laundry is within an allowable value using a difference between the variation in the speed of the drum 124 and a reference variation of the speed. The reference variation of the speed varies according to the laundry load. The control unit 141 stores a table of unbalanced degrees of the laundry relative to the reference variations of the speed according to the laundry load. See e.g., Table I.

TABLE I

| | Speed of Drum | | |
|---|---|---|---|
| Load of Laundry | 60 Allowable Value | 70 Allowable Value | 80 Allowable Value |
| 1 | 60 | 60 | 55 |
| 2 | 45 | 45 | 40 |
| 3 | 50 | 50 | 40 |

TABLE I-continued

| Load of Laundry | Speed of Drum 60 Allowable Value | 70 Allowable Value | 80 Allowable Value |
|---|---|---|---|
| 4 | 50 | 35 | 30 |
| 5 | 35 | 30 | 20 |

It is preferable that the control unit 141 actually store two tables, i.e., a first table for when wash water is contained in the drum 124 and a second table for when wash water is not contained in the drum 124. The first table is used in the balancing process 213 of the wash cycle 210 or the balancing process 227 of the rinse cycle 220. The second table showing unbalanced degrees of the laundry when wash water is not contained in the drum 124 is used for balancing during the main-spinning process 232 of the spin cycle 230.

The control unit 141 may accelerate or decelerate the drum 124 according to unbalanced degree of the laundry. That is, the control unit 141 may adjust the acceleration or a deceleration of the drum 124 according to the unbalanced degree of the laundry. In an extreme case, the control unit 141 may stop the drum 124, if the laundry is excessively unbalanced.

Additionally, the control unit 141 repeats the acceleration and deceleration of the drum 124 according to the unbalanced degree of the laundry. Moreover, the control unit 141 may continuously accelerate and decelerate the drum 124, if the unbalanced degree of the laundry is more than the allowable value. The control unit 141 stops the acceleration and deceleration of the drum 14 (i.e., stops the acceleration process) and carries out the next operation, once the unbalanced degree of the laundry is determined to be within the allowable value, as shown, for example in Table I.

If the unbalanced degree of the laundry is more than the allowable value and the acceleration and deceleration of the drum 124 is continuously repeated, the control unit 141 may stop the acceleration and deceleration of the drum 124. That is, if the acceleration and deceleration of the drum 124 is repeated more than an allowable number of times, it is preferable that the control unit 141 inform the display unit 114*a* that there is an abnormality and then stop the drum 124. If the unbalanced degree of the laundry is within the allowable value, the control unit 141 stops the balancing process 213 and performs the draining 214, as shown in the wash cycle 210 of FIG. 4. More specifically, if the variation of the speed of the drum 124 after the acceleration of the drum 124 is smaller than the reference variation of the speed, the control unit 141 decelerations and stops the drum 124. It then operates the pump 136 to drain the wash water in the tub 122 to the outside along the drain channel 138.

The details of balancing process 213 of the wash cycle 210 are applicable to the balancing process 227 of the rinse cycle 220.

Figure 8:
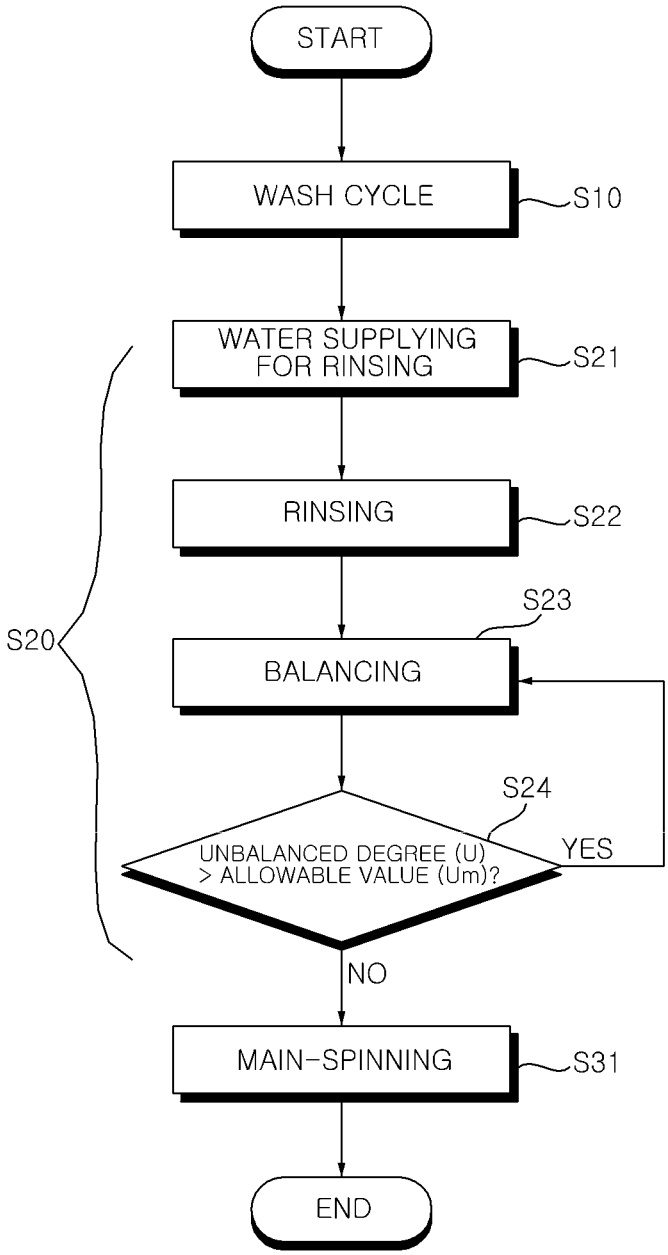
FIG. 8 is a flow chart further illustrating a method for washing laundry that includes balancing in accordance with exemplary embodiments of the present invention.

FIG. 8 is a flow chart illustrating the method for washing in accordance with exemplary embodiments of the present invention. As shown, when a user inputs various washing conditions through the input unit 114*b*, the operation of the washing machine 100 is started. Through the input unit 114*b*, the user may select the wash cycle 210, the rinse cycle 220, and the spin cycle 230 to be continuously carried out. Alternatively, the user can select a desired cycle from amongst the wash cycle 210, the rinse cycle 220, and the spin cycle 230. Hereinafter, the method for washing laundry, in which the wash cycle 210, the rinse cycle 220, and the spin cycle 230 are continuously carried, will be described. If the laundry is the type that is easily tangled or unbalanced, the user may select a specific washing course whereby an unbalancing process is carried out during the wash cycle and/or the rinse cycle. Further, the user may adjust the time of the washing course.

After the wash cycle 210 is carried out (S10), the rinse cycle 220 is started (S20). During the wash cycle 210, as shown in FIG. 4, the water supplying process 211, the washing process 212, the balancing process 213, the draining process 214, and the simple-spinning process 215 may be sequentially performed.

During the rinse cycle 210, the water supplying process 221 and the water supplying process 225 to rinse the laundry are performed, the rinsing process 222 and the rinsing process 226 using the supplied wash water are performed, and the balancing process 227 by accelerating and decelerating the drum 124 as described above is performed (S23).

The overall configurations of the wash cycle 210 and the rinse cycle 220 are the same as those described above with reference to FIG. 4, and a detailed description thereof will thus be omitted.

In the washing method in accordance with the exemplary embodiments of the present invention, whether or not the main-spinning process 232 is performed is determined based on the unbalanced degree U of the laundry as measured when the balancing process 227 of the rinse cycle 220 is performed. More specifically, the balancing process 227 of the rinse cycle 220 is performed under the condition that wash water is supplied to the inside of the drum 124, whether or not the unbalanced degree U of the laundry as measured at this time is within an allowable value Um is determined (S24). Then the main-spinning process 232 is performed according to this result of the determination (S31). Here, the allowable value may be set to different values according to loads of the laundry.

The main-spinning process 232 involves dehydrating the laundry by accelerating the drum 124. During the main-spinning process 232, the drum 124 is rotated at a speed greater than necessary for the laundry to adhere to the inner wall of the drum 124 by centrifugal force. During the main-spinning process 232, balancing is omitted. The rotational speed of the drum 124 may be more than 1,000 rpm, as described above. According to exemplary embodiments, if the level of the wash water in the tub 122 exceeds the allowable value, the draining process 231 may first be performed and then the main-spinning process 232 may be performed.

During the main-spinning process 232, the wash water removed from the laundry is drained to the outside of the cabinet 111. If the unbalanced degree U of the laundry is within the allowable value Um, the control unit 141 controls the driving unit 113 so as to accelerate the drum 124, and operate the pump 136, thereby performing the main-spinning process 232. Here, the control unit 141 displays the spin icon in the progress display of the display unit 114*a*, as shown in FIG. 6. This indicates that the spin cycle 230 has started.

The indication that the spin cycle 230 has started is not limited to the visual output on the display unit 114*a*. An indication may be carried out by a sound output through a buzzer or a speaker.

Since the balancing process 227 is performed under the condition that the drum 124 is filled with wash water, draining of the wash water, which is conventionally performed prior to the balancing, may be omitted, and when it is determined that the laundry in the drum is uniformly dispersed (U<Um), the main-spinning process 232 is directly performed such that spinning and draining may be simultaneously performed, thereby reducing the overall time required to carry out the spin cycle 230.

During the main-spinning process 232, the pump 136 may be operated according to the water level in the tub 122. Alternatively, the pump 136 may be intermittently operated at regular periods.

On the other hand, if the unbalanced degree U of the laundry is greater than the allowable value Um, the balancing process 227 is repeated a set number of times or until the unbalanced degree U of the laundry is less than the allowable value Um (S23). If the acceleration and deceleration of the drum 124 is continuously repeated more than an allowable number of times, the control unit 141 may inform the display unit 114*a* that there is an abnormality and then stop the drum 124.

As described above, spinning according to the unbalanced degree U of the laundry is not limited to entry of the main-spinning process 232 from the balancing process 227 of the rinse cycle 220. The same is applicable to entry of the simple-spinning process 215 from the balancing process 213 of the wash cycle 210. If the simple-spinning process 215 is performed, it is preferable that the simple-spinning process 215 and the draining process 214 be simultaneously performed.

It will be understood by those skilled in the art that example embodiments can be implemented in other specific forms without changing the technical spirit or essential features of the present invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

According to the method for washing and washing machine of the present invention, one or more effects as follows may be achieved. First, balancing is performed under the condition that wash water is contained in the tub, thereby effectively eliminating tangling of the laundry. Second, the unbalanced degree of the laundry during the rinse cycle is measured, and if the unbalanced degree of the laundry is within an allowable value, main-spinning is directly performed, thereby shortening the time required to carry out the spin cycle and reducing energy consumption. Third, balancing is performed during the wash cycle or the rinse cycle, thereby shortening or omitting balancing in the spin cycle. Fourth, balancing is effectively performed, thereby shorting the overall washing time. Fifth, balancing is effectively performed, thereby reducing noise and vibration during the spin cycle.

The effects of the present invention are not limited to the above-mentioned effects, and other effects not mentioned above can be clearly understood from the definitions in the claims by one skilled in the art.

What is claimed is:

1. A method for washing laundry in a washing machine, wherein the washing machine includes a tub and a drum positioned in the tub, the method comprising:

indicating a start of a rinse in a progress display;

supplying wash water and detergent to the tub and drum, thereby wetting the laundry located in the drum;

sensing a level of the wash water in the tub;

rotating the drum thereby causing the laundry to be lifted within and to fall towards the bottom of the drum as the drum rotates;

balancing the laundry by repeatedly accelerating and decelerating the drum while the supplied wash water is contained in the tub without draining the supplied wash water from the tub and the drum after the supplying the wash water;

draining the wash water contained in the tub from the tub when the level of the wash water in the tub exceeds an allowable value;

indicating a start of a spin cycle in a progress display; and accelerating the drum to dehydrate the laundry with draining the wash water from the tub and drum, wherein when the level of the wash water in the tub does not exceed the allowable value, accelerating the drum to dehydrate the laundry right after the balancing the laundry and the indicating the start of the spin cycle with skipping the draining step.

2. The method for washing laundry according to claim 1 wherein determining whether the laundry in the drum is unbalanced comprises:

measuring a variation in the rotational speed of the drum;

comparing the measured variation in the rotational speed of the drum to a predetermined variation in the rotational speed of the drum; and determining the laundry is unbalanced based on said comparison.

3. The method for washing laundry according to claim 2 wherein determining the laundry is unbalanced is based on a difference value between the measured variation in the rotational speed of the drum and the predetermined variation in the rotational speed of the drum.

4. The method for washing laundry according to claim 2 wherein determining the laundry is unbalanced if the measured variation in the rotational speed of the drum is greater than the predetermined variation in the rotational speed of the drum.

5. The method for washing laundry according to claim 2 further comprising:

measuring a deceleration time of the drum; and determining laundry load as a function of the deceleration time.

6. The method for washing laundry according to claim 5 wherein the predetermined variation in the rotational speed of the drum is a function of the laundry load.

7. The method for washing laundry according to claim 2, wherein balancing the laundry comprises:

repeatedly accelerating and decelerating the drum according to a degree to which the laundry is unbalanced.

8. The method for washing laundry according to claim 1 wherein balancing the laundry comprises:

accelerating the drum to a rotational speed at which the laundry adheres to the inner wall of the drum.

9. The method for washing laundry according to claim 8, wherein the rotational speed is 80 rpm.

10. The method of washing laundry according to claim 1 wherein balancing the laundry is accomplished when the washing machine is operating in a washing cycle.

11. The method of washing laundry according to claim 1 wherein balancing the laundry is accomplished when the washing machine is operating in a rinsing cycle.

12. The method for washing laundry according to claim 2, wherein the predetermined variation is for when the wash water is contained in the drum, not for when the wash water is not contained in the drum.

* * * * *